US012760920B2

(12) United States Patent
Sarkar et al.

(10) Patent No.: US 12,760,920 B2
(45) Date of Patent: Oct. 13, 2026

(54) REAL-TIME CARBON FOOTPRINT REDUCTION CONTROLLER

(71) Applicant: HEWLETT PACKARD ENTERPRISE DEVELOPMENT LP, Spring, TX (US)

(72) Inventors: Soumyendu Sarkar, Milpitas, CA (US); Avisek Naug, Milpitas, CA (US); Ricardo Luna Gutierrez, Milpitas, CA (US); Antonio Guillen Perez, Milpitas, CA (US); Sahand Ghorbanpour, Milpitas, CA (US)

(73) Assignee: Hewlett Packard Enterprise Development LP, Spring, TX (US)

( * ) Notice: Subject to any disclaimer, the term of this patent is extended or adjusted under 35 U.S.C. 154(b) by 417 days.

(21) Appl. No.: 18/492,176

(22) Filed: Oct. 23, 2023

(65) Prior Publication Data

US 2024/0392988 A1 Nov. 28, 2024

Related U.S. Application Data

(60) Provisional application No. 63/504,664, filed on May 26, 2023.

(51) Int. Cl.
*F24F 11/46* (2018.01)
*F24F 140/50* (2018.01)
*F24F 140/60* (2018.01)

(52) U.S. Cl.
CPC ..... *F24F 11/46* (2018.01); *F24F 2140/50* (2018.01); *F24F 2140/60* (2018.01)

(58) Field of Classification Search
CPC .... F24F 11/46; F24F 2140/50; F24F 2140/60; G05B 19/0423; G05B 2219/25257
See application file for complete search history.

(56) References Cited

U.S. PATENT DOCUMENTS

2021/0334696 A1* 10/2021 Traut ..... G06F 11/3698
2022/0390137 A1* 12/2022 Wenzel ..... F24F 11/64

FOREIGN PATENT DOCUMENTS

CN 112966431 A * 6/2021 ..... G06F 30/27

OTHER PUBLICATIONS

Anonymous, "Carbon Footprint Reduction for Sustainable Data Centers in Real-time", 37th Conference on Neural Information Processing Systems, 2023, 11 pages.

(Continued)

*Primary Examiner* — Charles Cai
(74) *Attorney, Agent, or Firm* — Sheppard Mullin Richter & Hampton LLP

(57) ABSTRACT

Systems and methods are provided for optimizing energy consumption, flexible load shifting, and battery operation decisions simultaneously in real-time through Reinforcement Learning (RL). Examples include obtaining states of a system comprising a plurality of subsystems and receiving, by RL agents, rewards from a digital twin of the system, the rewards comprising a plurality of rewards each associated with a subsystem. The example also include determining actions, by the RL agents, based on the states and each of the rewards. Each RL agent is associated with a subsystem and assigns a weight to a reward corresponding to the associated subsystem that is greater than weights assigned to rewards of the other subsystems. The system can then be controlled according to the actions to transition the system to updated states.

16 Claims, 5 Drawing Sheets

(56) References Cited

OTHER PUBLICATIONS

Anonymous, "Concurrent Carbon Footprint Reduction (C2FR) Reinforcement Learning Approach for Sustainable Data Center Digital Twin", 2023, 8 pages.
Sarkar et al., "Carbon Footprint Reduction for a Data Center Digital Twin with a Reinforcement Learning Agent", Hewlett Packard Enterprise Confidential, 2023, 4 pages.

* cited by examiner

REAL-TIME CARBON FOOTPRINT REDUCTION CONTROLLER

CROSS-REFERENCES TO RELATED APPLICATIONS

This application claims the benefit of and priority to U.S. Provisional Application No. 63/504,664, filed on May 26, 2023, the contents of which is incorporated herein by reference in its entirety.

BACKGROUND

Carbon footprint functions as an indicator that compares the total amount of greenhouse gases emitted from a system. A commonly used definition of carbon footprint is a measure of the total amount of carbon dioxide ($CO_2$) and methane ($CH_4$) emissions of a defined system, considering all relevant sources, sinks and storage within the spatial and temporal boundary of the system. Carbon footprint is usually reported in tons of emissions ($CO_2$-equivalent) per unit of comparison, such as per year, per month, and the like. For a system, the carbon footprint can include direct emissions, as well as, the indirect emissions caused by the system. Direct emissions refer to emissions from sources that are directly from the system and indirect emissions refer to emissions from sources upstream or downstream from the system derived from activities of the system, whether controlled by the system or not.

BRIEF DESCRIPTION OF THE DRAWINGS

The present disclosure, in accordance with one or more various embodiments, is described in detail with reference to the following figures. The figures are provided for purposes of illustration only and merely depict typical or example embodiments.

Figure 1A:
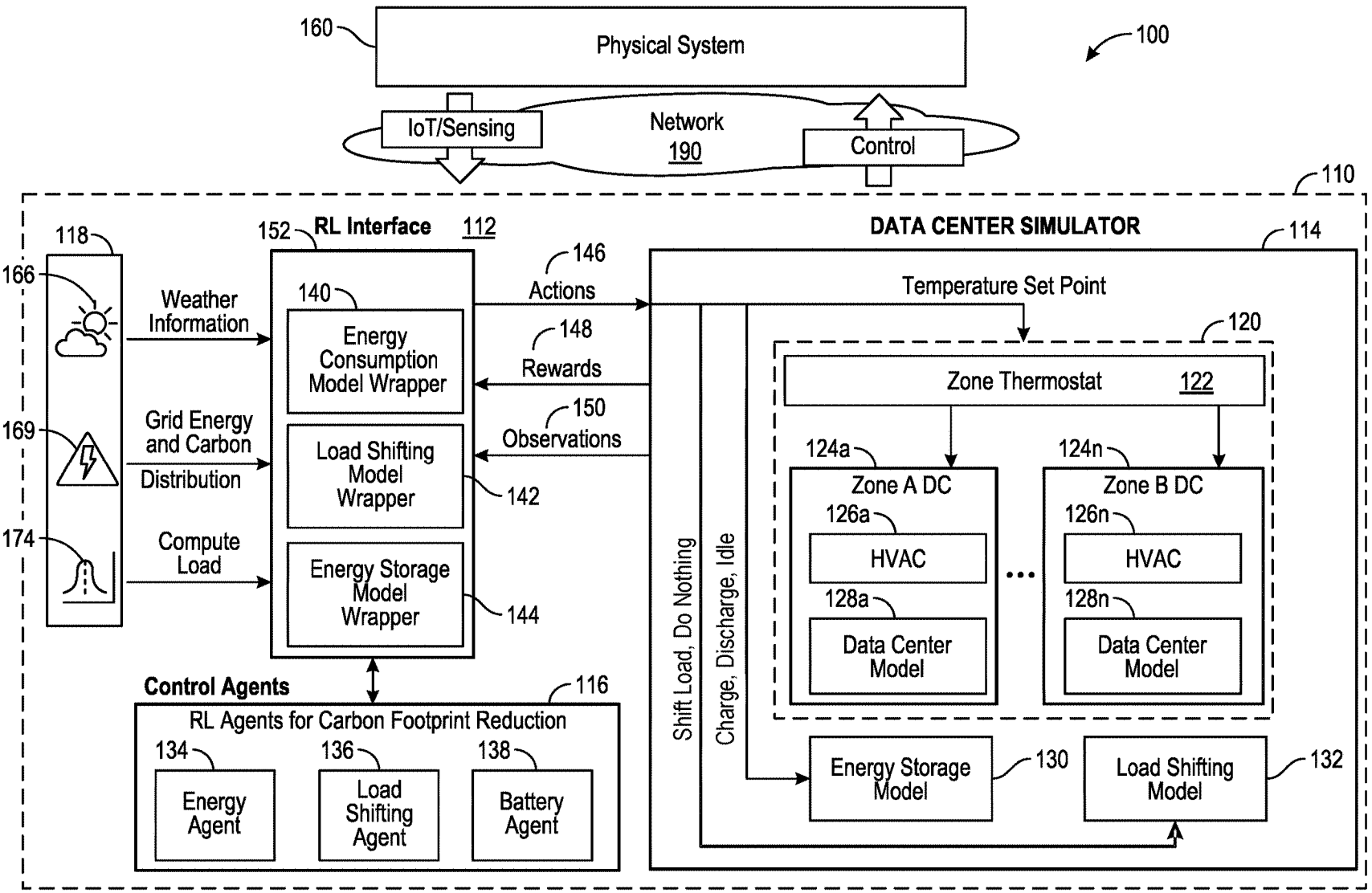
FIGS. 1A and 1B depict an architecture of an example Data Center-Carbon Footprint Reduction (DC-CFR) framework in accordance with implementations of the present disclosure.

The figures are not exhaustive and do not limit the present disclosure to the precise form disclosed.

DETAILED DESCRIPTION

Sustainability with carbon footprint reduction is becoming a priority for governments and corporations worldwide. The current rise in global average temperature is more rapid than previous changes, and is primarily caused by activities that are burning fossil fuels to supply electricity and power. Information and communication technology is projected to account for 7% to 20% of the global electricity demand by 2030. Data centers account for a large percentage of the resulting global carbon footprint. Carbon footprint demand of these data centers is estimated to trend higher over the coming years, increasing by 6-fold every ten years.

Achieving sustainability can involve optimizing various interdependent power consumption factors of data centers, such as power consumed operating the data center (e.g., in cooling and by information technology (IT) workload), shifting flexible workload based on availability of renewable energy in a power grid, and leveraging power stored in batteries from the power grid. Flexible load refers to certain IT workloads that are permissible to shift from one task to another or from one time to another to optimize other aspects of the data center. While static or inflexible workloads are those workloads that are not permissible to shift and may be necessary to complete a task as scheduled.

Conventionally, optimization on these power consumption factors is done offline, where each factor is optimized separately and in isolation. The conventional systems lack an ability to concurrently optimize the various power consumption factors of data centers in real-time. This is because concurrent optimization is a difficult problem to solve due to complex interdependencies between the various power consumption factors to be optimized, as well as, dependencies of power consumption factors on external factors, such as, but not limited to, weather and the availability of renewable energy in the power grid.

Analytic methods have been proposed. But these proposed methods rely on offline static analysis and do not optimize data center cooling (e.g., Heating, Ventilation and Air Conditioning (HVAC) systems) with external factors, such as weather forecasting, to simultaneously reduce total energy consumption with comprehensive carbon reduction actions. Further, the static analysis methods collect day ahead carbon intensity (CI) forecasts, train day ahead energy supply and demand prediction models, and use them to analytically find the best data center workload distribution to minimize the total carbon footprint. These day-ahead analysis may overlook net carbon footprint due to moving workloads within a 24-hour period, thus lacking granularity for real-time implementations. Furthermore, relying on long term forecast models may not be feasible due to changing weather patterns. Additionally, the complex interdependencies between energy consumption, load balancing, and energy storage, along with the information exchange across the separate aspects, have hindered prior development of a cohesive strategy that simultaneously reduces the carbon footprint using all three opportunities in real-time. Thus, achieving carbon footprint reductions for an entire system with these analytic methods has proven challenging due to the complexity of these individual problems, as well as, a reliance on relatively long forecast horizons (e.g., 24 hour).

In contrast, examples of the technology of the present disclosure provides for a framework that leverages Reinforcement Learning (RL) to optimize energy consumption, flexible load shifting, and battery operation decisions simultaneously in real-time that overcomes the technical shortcomings of the prior solutions. This optimization can be based on external factor forecasts (e.g., carbon intensity on the grid and weather conditions to name a couple examples) using multiple agents. Such forecast may relatively short horizons, for example, less than 24 hour forecasts, less than 12 hour, less than 1 hour, etc. In some cases, the forecast horizons of the present disclosure may be very short, for example, 1 minute horizons or less. Thus, the implementation disclosed herein can be based on forecasts of any short term horizon as desired for a desired application. Thus, the technology disclosed herein can effectively mitigate drawbacks of existing, isolated methods by providing a framework that manages the complex interdependencies and information exchange among individual optimization strategies employed by competing data center subsystems.

Carbon intensity (CI) as used herein refers to an amount of carbon dioxide ($CO_2$) emissions produced by the power grid per unit of electricity consumed from the grid, which varies based on the source of the electricity (e.g., fossil fuels, renewable energy, etc.) and energy consumers at a given point of time. Thus, a high draw of non-renewable energy sources from the grid would be considered a high CI period, while a lower CI means that energy is available from greener energy sources.

The framework according to the present disclosure provides a digital twin of a real-world data center that simulates the operations of the data center. The framework utilizes RL to holistically optimize power consumption factors (e.g., energy consumption, load shifting, and energy storage operations) for the digital twin in real-time and learn optimized policies that be used to control operations of the real-world data center. The digital twin can be informed by the data center on real-time changes in operating conditions that can dynamically adapt the digital twin to the changing conditions. The framework simultaneously optimizes the power consumption of the digital twin through RL informed by the changing operating conditions. Examples of the disclosed technology address the exponential growth of the power consumption demands by decoupling the problems into separate sub-problems through RL Markov Decision Processes (MDP) formulations. The disclosed technology simultaneously solves the RL MDP formulations to develop a real-time carbon footprint optimization strategy tailored for sustainable and carbon footprint reduction. The optimized strategies can then be utilized to configure and control operations of the real-world data center.

In example implementations, the framework includes a plurality of RL agents, trained on historical data to form adaptive policies optimized to address the complex and interrelated power consumption factors in real-time. The framework manages the complex interdependencies and information exchange between these RL agents, through the MDP formulations, to provide an integrated real-time solution for carbon footprint reduction.

According to examples disclosed herein, from a control perspective, a data center can be divided into a number of subsystems, such as a cooling subsystem (e.g., an HVAC system), a load shifting subsystem that shifts flexible workload of the data center, and energy storage subsystems that consists of energy storage devices (e.g., batteries of a UPS system) that can be charged from the power grid and discharged for uninterrupted power supply. Each subsystem can be simulated by a corresponding subsystem model (also referred to as a subsystem digital twin), which can be comprised as part of the systemwide digital twin. An RL agent of the plurality of RL agents can be associated with each subsystem and interfaced with a corresponding subsystem model. For example, an energy optimization RL agent can be provided interfaced with cooling subsystem model and configured to determine optimized policies for controlling the cooling subsystem to minimize total energy consumption due to IT workload and cooling. This RL agent can leverage weather forecasts to further optimize energy reduction. A load-shifting RL agent can be provided interfaced with a load shifting subsystem model and configured to determine optimized policies for shifting of flexible load from time periods of low renewable energy availability on the power grid to high availability (e.g., high to low carbon intensity (CI) on the grid). The load-shifting RL agent can also leverage future predictions of CI (e.g., high CI may occur during mid-day where there are high IT loads) and weather forecast data. An energy storage RL agent can also be provided interfaced with an energy storage subsystem model and configured to determine optimized policies for energy storage in batteries of energy storage subsystem during low CI periods and discharges stored energy from the batteries during high CI periods to assist with data center energy consumption demands. The energy storage RL agent can also account for a batteries' nonlinear charging and discharging patterns.

The framework, according to various implementations, can manage the complex interdependencies and information exchange between the plurality of RL agents through a collaborative reward. The collaborative reward includes rewards for each subsystem model and each reward is uniquely weighted for each RL agent. That is, for example, each subsystem model can output a reward (e.g., cooling subsystem model outputs a cooling reward, load shifting subsystem model outputs a load shifting reward, etc.). The individual rewards can be combined into a collaborative reward that is tailored for each respective RL agent by weighting a reward output by a subsystem model associated with the a given RL agent greater than the other rewards. For example, in the case of the energy optimization RL agent, the reward output by the cooling subsystem model may be weighted at 0.8, while the other rewards weighted at 0.1. In this way, each agent can be cognizant of all other rewards, and can determine actions that optimize the entire system, opposed to selfish individual optimization. This contrasts with the conventional non-RL based systems, where each subsystem is not aware of or took consideration, in real-time, of considerations and actions of other subsystems.

Based on the individually tailored collaborative rewards, provided in the disclosed technology, and real-time operating conditions of the data center, each RL agent can determine actions for controlling its corresponding subsystem so to optimize not only the individual subsystem, but optimize system wide data center operations. The individually tailored collaborative rewards enable each individual agent to account for the various interdependencies between the subsystems.

Accordingly the technology disclosed herein provides for a multi-agent RL based carbon emission-aware real-time holistic control framework for optimizing sustainable data centers by efficient cooling, redistributing flexible server workloads, and battery storage for auxiliary energy supply. The technology disclosed herein can help resolve complex interdependencies between controlling RL agents with dynamic external dependencies and creates performance gain over static optimizers, as described above. Further, the technology disclosed herein can optimize a data center for multiple objectives of carbon footprint reduction, energy consumption, and energy cost. Optimizations by the disclosed technology can be performed using with industry-standard simulators and models across multiple geographical locations, where data center construction is feasible, with the different weather patterns and across multiple seasons. The disclosed technology can be capable of, for example, achieving an average of 8.04% reduction in energy cost compared to conventional control based on industry standards set by American Society of Heating, Refrigerating and Air-Conditioning Engineers (ASHRAE) and Residential Building Committee (RBC). Furthermore, the technology, according to the present disclosure, can enable additional emission reductions through battery and load-shifting optimization, resulting in an average reduction of, for example, 9.06% in carbon emissions across different data center configurations.

Additionally, the framework comprising a data center digital twin, control RL agent, and RL interface, provides for a scalable and modular architecture that can be extended to additional optimizing controllers and can help democratize the carbon reduction efforts by the ecosystem. For example, implementations of the present disclosure can scale across multiple physical portions of a data center (e.g., multiple rooms, multiple cities, multiple geographic regions, etc.). Scalability can be achieved through the digital twin, which can model each subsystem as a whole or partition the subsystems to smaller portions (e.g., per room, per geographic region, etc.).

It should be noted that the terms "optimize," "optimal," and the like, as used herein, can be used to mean making or achieving performance as effective or perfect as possible. However, as one of ordinary skill in the art of reading this document will recognize, perfection cannot always be achieved. Accordingly, these terms can also encompass making or achieving performance as good or effective as possible or practical under the given circumstances, or making or achieving performance better than that which can be achieved with other settings or parameters.

Figure 1B:
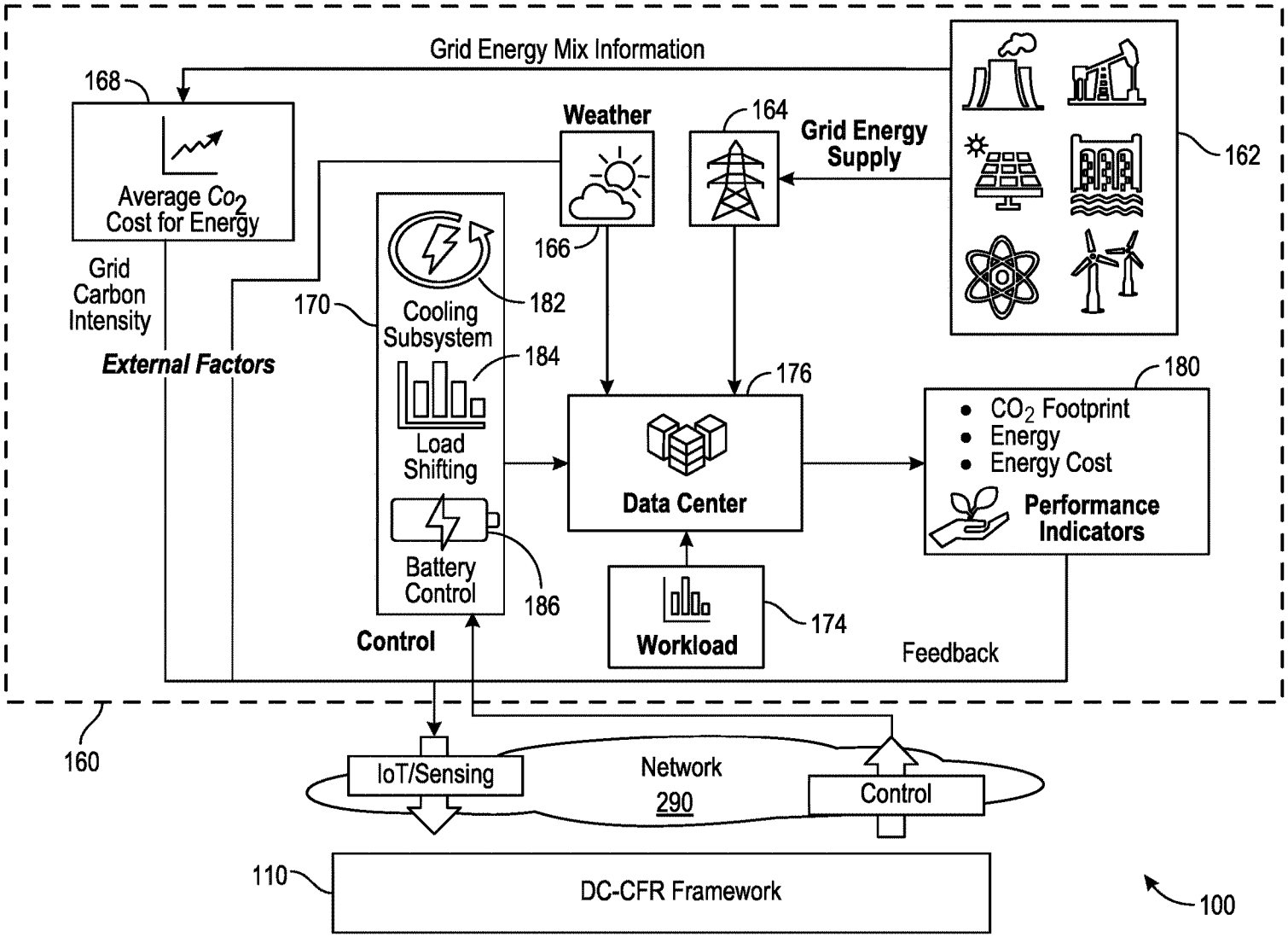

FIGS. 1A and 1B depict a system architecture 100 of an example Data Center-Carbon Footprint Reduction (DC-CFR) framework in accordance with implementations of the present disclosure. The system architecture 100 comprises a framework 110 communicatively coupled to a physical system 160 over a network 190. As used herein, the term "framework" refers to a combination of components (e.g., combinations of a microprocessor, a core of a multi-core microprocessor, a microcontroller, a programmable integrated circuit, a programmable gate array, or the like), and the ways in which those components communicate with one another.".

In this example, the physical system 160 is provided as a physical, real world data center that is simulated by framework 110. Framework 110 comprises a digital twin 114, which is a digital model of data center 176 configured for simulating operations of the data center 176. Digital twin 114 can be a digital recreation of physical system 160 implemented as executable code stored on a memory and executed by a processor (e.g., such as computer system 500 described in connection FIG. 5).

The physical system 160 can comprise various sensors and Internet-of-Things for sensing operating conditions of the physical system 160 under which real world data center 176 operates. The operating conditions can be communicated to framework 110 as input data over the network 190. The input data can be supplied to the framework 110 in real-time as the operating conditions are sensed at physical system 160. Framework 110 can receive the input data and inject the input data as states into digital twin 114. By applying the states to digital twin 114, operations of the of the physical system 160 can be simulated under the operating conditions represented by the input data.

The framework 110 can be configured to, based on the simulations, execute machine learning (ML) models to make decisions on actions to transition operating states of the framework 110 that optimize the framework 110 for multiple objectives of carbon footprint reduction, energy consumption, and energy cost. Actions determined to optimize the multiple objectives can be communicated to the framework 110 over a network 190 as instructions for controlling the data center 176 according to the determined actions. As result, the physical system 160 can then be controlled in a manner that optimizes the data center 176 for the multiple objectives of carbon footprint reduction, energy consumption, and energy cost across the physical system 160.

As alluded to above, digital twin 114 is a model that can simulate operations of the entire data center 176. Digital twin 114 comprises a plurality of a subsystem digital twins or models each of which simulates operations of a discrete subsystem of the data center 176. The subsystem models can be executed by applying states and actions that transition to the models to a next state. Each model simulates operations (e.g., actions) of the respective subsystem according to the states. States may refer to a set of information that define operating conditions to be simulated at a given point in time. States may be based on information obtained from the physical system 160. In this example, digital twin 114 includes a cooling subsystem model 120, an energy storage subsystem model 130, and a load (e.g., workload) shifting model subsystem model 132.

The cooling subsystem model 120 can mimic or otherwise simulate data center temperature regulation through, for example, HVAC systems and temperature monitoring through a thermostat 122. That is, the cooling subsystem model 120 may include a HVAC system model that can be simulated to control temperatures of a digital twin 114 through monitoring of simulated temperatures by a thermostat 122. In this case, actions input into cooling subsystem model 120 may include a temperature set point for the data center that is set within the model and used for controlling operations of the HVAC system model.

In some embodiments, as shown in FIG. 1A, the cooling subsystem model 120 can comprise one or more zones 124*a*-124*n* that can represent different subsets of data centers. For example, an enterprise may operate a number of discrete data centers distributed across various regions. Different regions experience different weather conditions and other variations in operating conditions that impact temperature regulation of each data center. To address such a configuration, cooling subsystem model 120 may include a number of separate discrete zones 124*a*-124*n*, each configured to model cooling subsystems for that zone. Each zone 124*a*-124*n* includes a corresponding HVAC system model 126*a*-126*n* and a data center model 128*a*-128*n*, respectively, for separately modeling each zone. The thermostat 122 operates to monitor each zone's simulated temperature in view of the temperature set point. The temperature set point may be defined in advance of a simulation step. While the example provided herein is with respect to regional differences, other divisions of data centers are within the scope of the present disclosure.

The energy storage subsystem model 130 can mimic or otherwise simulate energy storage by the data center at battery subsystems. For example, the Energy storage subsystem model 130 may include a UPS system model that can be simulated for energy storage and discharge from batteries. Energy storage subsystem model 130 can simulate charging of battery subsystems for energy storage and discharging for energy usage according to the simulation of the data center.

The load shifting model subsystem model 132 can mimic or otherwise simulate shifting of flexible workload performed during simulation of the data center. For example, operations performed by the data center can require utilization of computation resources which loads the data center. The load shifting model subsystem model 132 can be configured to simulate shifting workloads between available resources for completing tasks. Certain workloads can be considered as flexible loads that can be permissible to shift to optimize other aspects of the data center based on operating conditions, such as CI and weather forecasts. For example, it may be optimal to shift flexible workloads to low CI periods and/or low weather forecasts, which may reduce carbon emission by the data center.

Framework 110 also includes control agents 116 configured to provide instructions for controlling the digital twin 114 in the form of actions. Control agents 116 comprises a plurality of RL agents 134-138, each of which corresponds to a subsystem of the data center. Each RL agent 134-138 can be provided as a machine learning algorithm that receives states 118 in the form of input data from the physical system 160, such as, but not limited to, weather information (e.g., weather forecasts); grid, energy, and carbon distribution, computed workload, and other operating conditions. Each RL agent 134-138 can also receive simulated states in the form of state information 150 (also referred to as observations) from the digital twin 114, which represent current states (e.g., simulated operating conditions) of the subsystem models.

The machine learning algorithm of each RL agent 134-138 may be a reinforcement leaning algorithm that trains each respective RL agent on a corresponding policy configured to optimize an individually tailored collaborative reward (as will be described below in more detail). The individually tailored collaborative reward may be representative of an effectiveness of actions based on the input states 118, which can be used to inform the policy for determining future actions. The policy applied by each RL agent attempts optimize both its own associate subsystem model, while taking into consideration optimal systemwide operations.

Each subsystem model calculates and outputs a corresponding reward included in reward information 148 that is provided to control agents 116. The individual corresponding rewards can be aggregated and weighted in a manner that is individually tailored for each subsystem, such that the RL agents 134-138 can determine actions that are both optimal for its own subsystem model as well as the system as a whole.

In the example of FIG. 1A, control agents 116 includes an energy consumption RL agent 134, a load shifting RL agent 136, and an energy storage RL agent 138. The energy consumption RL agent 134 is configured to optimize the energy consumption of the real-world cooling subsystem through interactions with the cooling subsystem model 120. The load shifting RL agent 136 is configured to optimize the workload shifting of the real-world load shifting subsystem through interactions with the load shifting model subsystem model 132. The energy storage RL agent 138 is configured to optimize the energy storage of the real-world battery subsystem through interactions with the energy storage subsystem model 130.

Data centers, such as data center 176, may represent a significant portion of global energy consumption and endeavors to curb carbon emissions have grown. One approach is carbon-aware workload scheduling (CAS), which leverages flexible workloads to lower carbon emissions by rescheduling them to periods of low CI. Although not all workloads are flexible (e.g., tolerant of delay), there are some applications such as data processing where a considerable fraction of the workload can be postponed.

The control agents 116, such as, for example, load shifting RL agent 136, can be used for optimizing workload scheduling in data centers. By training load shifting RL agent 136 to make intelligent decisions on when to allocate workloads, reductions in energy consumption and increased thermal efficiency can be achieved. Framework 110 can be implemented to simultaneously manage workload scheduling through load shifting RL agent 136 and cooling systems through energy consumption RL agent 134 to improve overall efficiency. The control agents 116 can utilize an event driven RL approach which reduces energy consumption by executing workload scheduling and cooling operations after specific events, such as rack overheating. Control agents 116 can also be utilized to predict thermal dynamics and reduce energy consumption through workload shifting. Additionally, control agents 116 can be implemented to optimize the above, while also addressing the source of the energy and optimization for carbon emissions.

Framework 110 also includes an RL interface 112, which provides a plurality of wrappers for interfacing with each of the RL agents 134-138. In the example of FIG. 1A, RL interface 112 includes an energy consumption wrapper 140 that can be provided to encapsulate the cooling subsystem model 120 and convert data to a format that can be applied to and processed by the cooling subsystem model 120. For example, energy consumption wrapper 140 can be provided to convert action 146 into a format executable by the cooling subsystem model 120. RL interface 112 also includes a load shifting model wrapper 142 and energy storage model wrapper 144 that can be provided to encapsulate the load shifting model subsystem model 132 and energy storage subsystem model 130, respectively, and convert data to a format that can be applied to and processed by each subsystem model. The RL interface 112 can also include an RL agent wrapper 152 provided to encapsulate the control agents 116 and convert data (e.g., states 118, reward information 148, and state information 150) into a format that can be processed by the RL agents.

Referring to FIG. 1B, the physical system 160 depicts an example schematic block diagram of a real world data center 176 and the environment in which data center 176 operates. For example, data center 176 may receive energy from a power grid 162 via an infrastructure 164. The power grid 162 comprises a plurality of energy sources, such as fossil fuel sources, renewable energy sources, etc. In the example shown in FIG. 1B, Power grid 162 includes non-renewable energy sources, such as, but not limited to, coal, natural gas, oil, nuclear energy sources, to name a few. Power grid 162 also includes renewable energy sources, such as, but not limited to, solar power, hydropower, clean nuclear energy sources, wind power, hydroelectricity, to name a few.

Power grid 162 also includes one or more sensor 168 configured to monitor energy levels on power grid 162 from the various energy source and determine a measurement of CI based on the energy levels on the power grid 162. In one example, CI may be measured as average $CO_2$ emissions produced by the power grid 162 per unit of electricity consumed from the grid 162 by energy consumers, including data center 176. In an example, the CI measurement an external factor that can be supplied to framework 110 as input data. In some example, sensors 168 may be, but not limited to, an energy meter that uses energy information to estimate the grid CI.

Physical system 160 may also include weather station sensors 166 or environmental monitoring devices configured to measure and quantify weather data for determining both current and predicted weather forecasts. Examples of environmental monitoring devices 166 include, but are not limited to, piezoelectric sensors and/or diaphragm sensors for detecting atmospheric pressure; temperature sensors (e.g., thermocouples, resistance temperature detectors (RTDs), thermistors, etc.) to measure temperature; humidity sensors (e.g., hygrometers, and the like) for measuring environmental humidity; wind speed and direction sensors (e.g., anemometers, aerovanes, and the like); rainfall sensors (e.g., rain gauge and the like). In an example, the weather data can be an external factor that can be supplied to framework 110 as input data.

Data center 176 receives workload data from workload requests 174. Workloads may define tasks and request data center resources for completing the tasks. In an example, workloads may be measured as a percentage CPU utilization (CPU %) determined based on the percentage needed for the workload to be performed. As suggested above, workloads may be flexible loads or non-flexible.

As described above, framework 110 can optimize policies that can be provided to data center 176 as optimization strategies for controlling operating conditions of the data center 176. In the example of FIG. 1B, framework 110 can supply the control instructions comprising the optimized strategies to subsystems 170. Control instructions can be provided as signals transmitted via network 190. As alluded to above, subsystems 170 may comprise a number of subsystems, such as, but not limited to, a cooling subsystem 182 (e.g., an HVAC system), a load shifting subsystem 184, and a battery subsystem 186. The cooling subsystem 182 may set a temperature set point according to control instructions from framework 110 and control operations of the HVAC system to not exceed the temperature set point. Load shifting subsystem 184 may receive control instructions that optimize current workload distributions to manage computation resources. Battery subsystem 186 may receive control instructions from framework 110 and charge and/or discharge batteries in accordance with the instructions.

The data center 176 outputs performance indicators 180 based on the operating conditions of the subsystems 170. The outputs performance indicators 180 may include, but are not limited to, carbon footprint based on current operating conditions, energy consumption (e.g., actual energy consumed as measured according to BTUs, kwh, etc.), and energy costs (e.g. a product of the energy consumption scaled by a value that determines a per-unit cost of the energy designated as unit cost/kwh or $/kwh). The outputs performance indicators 180 are feedback to framework 110 as input data that can define states for further refining the RL training of the control agents 116.

The network 190 may be a wired or wireless network that provides communicative exchange of information and data between framework 110 and physical system 160. Network 190 may also be a public or private network, such as the Internet, or other communication network to allow connectivity between framework 110 and physical system 160. The network 190 may include third-party telecommunication lines, such as phone lines, broadcast coaxial cable, fiber-optic-cables, satellite communications, cellular communications, and the like. The network 190 may include any number of intermediate network devices, such as switches, routers, gateways, servers, and/or controllers. The network 190 may include various servers or other computer system, such as computer system 500 of FIG. 5.

Figure 2:
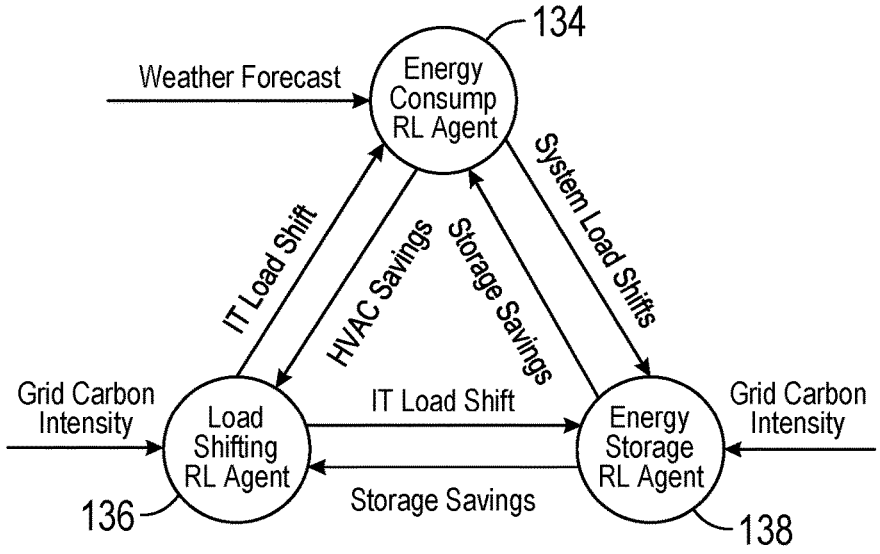
FIG. 2 is a schematic diagram of interdependencies and information exchange between subsystems of a data center.

FIG. 2 is a schematic diagram of interdependencies and information exchange between the RL agents 134-138 of FIG. 1A. FIG. 2 shows both internal and external dependencies on action determinations between the RL agents 134-138 of FIG. 1A. Arrows pointing toward a given RL agent represent external or internal dependencies that function as input states that impact action determinations made by the given RL agent. Arrows pointing away from an given RL agent represent actions that are determined by the given RL agent, which as shown in FIG. 2 can function represent an input state for another RL agent in making its own action determinations.

As described above, conventional carbon-reduction approaches lack real-time operation capabilities and do not effectively combine multiple control strategies due to the complex interdependencies and balancing objectives of competing RL agents, as illustrated in FIG. 2. The technology disclosed herein partially decouples the carbon footprint reduction into sub-problems. Each RL agent solves an individual Markov decision process (MDP) formulation, while aggregating individual rewards and overlapping state variables in a multi-agent setting to solve the complex dependencies in real-time. This design can provide a comprehensive, real-time carbon footprint optimizer for sustainable societies, advancing beyond existing strategies to offer an adaptable and robust solution.

MDP is a mathematical framework that provides a formal way to model decision-making in a dynamic environment, such as framework 110, where an RL agent's actions affect the state of the environment, and the environment's state determines the rewards and a subsequent state. Formally, an MDP can be defined as a tuple (S, A, P, R, $\gamma$). S is the state space that contains all possible states of the environment, which can be considered as framework 110 in the disclosed technology. A is the action space, which contains all possible actions that a given agent can provide to the environment for transitioning between states. P is the transition probability function, which defines the probability of moving from one state to another state given an action. R is the reward function, which calculates a reward the agent receives for taking an action in a given state. $\gamma$ is a discount factor, which determines the importance of future rewards relative to immediate rewards.

At each time, step t, the agent observes the current state $s_t \in S$, and selects an action $a_t \in A$ based on a policy $\pi(a_t/s_t)$. The action changes the state of the environment (e.g., transitions), and the agent receives a reward $r_t = R(s_t, a_t)$ from the environment based on the transition probability $P(s_{t+1}|s_t, a_t)$. Where $s_{t+1}$ represents a next state of the environment based on the action $a_t$ taken by the RL agent while in state $s_t$. In some examples, $s_t+1$ may be represented as $s_t'$.

To solve the MDP, RL algorithms can be used to optimize the policy $\pi(a_t/s_t)$ of the agent. The policy is a function that maps states to actions and determines the agent's behavior in the environment. During a training phase, the agent interacts with the environment, observing the current state and selecting actions to optimize the rewards. The agent's actions affect the state of the environment, which in turn affects the rewards and subsequent state. The agent learns from feedback provided by the environment in the form of rewards and adjusts its policy accordingly.

While the above discussion of the general MDP approach provides for a single agent approach, the implementations disclosed herein leverage the MDP to tackle the energy and carbon footprint reduction problem formulation for data centers by considering three interdependent MDPs that account for workload shifting, energy consumption through cooling optimization, and complementary energy supply using energy storage systems, respectively. To achieve this, three MDPs, described in Table 1 below, are constructed, one for each RL agent 134-138, that have the interdependencies summarized in FIG. 2 above: (1) a load shifting MDP ($MDP_{LS}$) that can be solved to reduce the carbon footprint by shifting data center workloads to low-carbon hours and reducing energy consumption; (2) an energy consumption MDP ($MDP_E$) that can be solved to reduce data center energy use by optimizing the cooling setpoint; and (3) an energy storage MDP ($MDP_{BAT}$) that can be solved to reduce the carbon footprint by charging and discharging the battery based on the grid carbon intensity. The energy consumption RL agent 134 can function to solve $MDP_E$; load shifting RL agent 136 can function to solve $MDP_{LS}$; and energy storage RL agent 138 can function to solve $MDP_{BAT}$.

The $MDP_E$ can be defined as follows. The state space S can consist of physical and thermal operating conditions of the data center (e.g., data center 176), denoted by $s_t \in S$. These can include external factors, such as, but not limited to, the relative outdoor temperature, indoor temperature, cooling setpoint, HVAC energy consumption, IT Energy (ITE) consumption, total energy consumption, as well as, the day of the year and the time of day. The external factors can be obtained, for example, from physical system 160 via various sensors and monitoring devices, as described above in connection with FIGS. 1A-1B. The state space S can also include states simulated by cooling subsystem model 120, which can be dependent on the interdependencies shown in FIG. 2. The action space A can be provided a discrete set of delta actions that represent changes in the cooling setpoint of the cooling subsystem, denoted by $a_t \in A$. Example delta actions can include, but are not limited to, {−5,−2,−1,−0.5, 0, 0.5, 1, 2, 5} provided in terms of degrees in either Fahrenheit, Celsius, Kelvin, etc. The transition function P ($s_{t+1}/s_t$, $a_t$) can be modeled by learning the physical and thermal properties of the data center, the cooling subsystem, and external weather forecast. The set point can be simulated by the cooling subsystem model 120 and represents a probability of transitioning from state $s_t$ to state $s_{t+1}$ after taking action $a_t$.

The reward function $r(s_t, a_t)$ can incentivize the energy consumption RL agent 134 to minimize energy consumption and total cost of electricity by multiplying the negative normalized total power consumption and the electricity price. This reward function can be referred to as the energy usage reward ($r_E$). It is defined as $r(s_t, a_t) = -c(s_t) \cdot e(s_t, a_t)$ where $c(s_t)$ is the electricity cost and $e(s_t, a_t)$ is the energy consumption in state $s_t$ after taking action $a_t$. Described another way, $r_E = -(\text{TotalEnergyConsumpt} \times \text{CostperkWh})$. The discount factor (γ) can be set to 0.99, in some examples, which means that future rewards are considered important. The goal of energy consumption RL agent 134 is to learn a policy $\pi(a_t|s_t)$ that maximizes the expected cumulative reward over time. To optimize the policy of the agent, a proximal policy optimization (PPO) algorithm or the like can be used.

During training, energy consumption RL agent 134 interacts with the simulated environment (e.g., cooling subsystem model 120) by observing the current state $s_t$ and selecting actions $a_t$ to optimize energy consumption and reduce costs. The actions taken by energy consumption RL agent 134 can affect the state of the environment, which in turn affects the rewards and subsequent state. The agent learns from the feedback provided by the cooling subsystem model 120 and adjusts its policy and value function accordingly.

For $MDP_{LS}$, the disclosed technology formulates the problem as a sequential MDP where the load shifting RL agent 136 has access to limited information. This is in contrast to conventional methods that rely on the assumption of having access to carbon intensity and workload information 24 hours in advance and utilize a static greedy algorithm for workload allocation. In this case, the load shifting RL agent 136 has access to N hours of future carbon forecasts. Load shifting RL agent 136 is given a certain amount of flexible workload at the start of each day, and selects the optimal time slots to assign the workload before the day ends. The data center capacity can be limited so workload cannot be assigned in all time slots.

As an example, a carbon-aware workload optimization $MDP_{LS}$ can be defined as follows. The state space S can be provided as $S:\{DC_t, LoadLeft_t, CI_t, \ldots, CI_{t+N}\}$ where $DC_t$ is the real-world data center workload (e.g., obtained from workload requests 174), $LoadLeft_t$ is the amount flexible workload to be assigned to data center resources within in a time limit N and CI is the current grid carbon intensity and its forecast up to a time-step t+N (e.g., obtained from one or more sensor 168). The action space A can be consider a binary discrete action space where $a_t \in \{0,1\}$ on in which load shifting RL agent 136 takes the decision of assigning certain amount of workload, which cannot exceed the maximum capacity, to the data center at the current time step tor to stay idle.

As an example, the reward function can be defined as $r_t = -(r_{carbon,t} + r_{penalty})$, where $r_{carbon,t}$ is the net carbon footprint for the data center energy consumption at time step t (e.g., $CO_2$ Footprint at time step f) and $r_{penalty}$ is a load shift penalty at the last time step of a day if the agent did not assign the predefined workload in the given timeframe, and 0 otherwise. The load shift penalty (or $LS_{Penalty}$) can be a scalar value of unassigned flexible workload that is selected to induce assigning of unassigned flexible workload. This reward function can be referred to as the load shifting reward function ($r_{LS}$), which can be described as $r_{LS} = -(CO_2\text{Footprint} + LS_{Penalty})$. To obtain the net carbon footprint for time step t, net energy drawn from the grid ($ng_t$) can be calculated based on the control decision and then multiplied with the corresponding carbon intensity of the grid at that time step t (e.g., $CI_t$). The transition function $p(s_t, a_t, s_{t+1})$ can be based on a deterministic model. A base workload may be provided, which is not flexible at each time step. The base workload can be increased by assigning new workload from the flexible budget at each time step t, until the flexible workload budget is empty or the data center is at max capacity. In an example implementation, the workload scheduling timeframe can be restricted to a 24-hour window with a forecast horizon of N=4.

For battery performance optimization, the $MDP_{BAT}$ can be provided as follows. The state space can be provided as $S:\{Load_{dc}, Battery_{SOC}, CI_t, \ldots, CI_{t+N}\}$, where $Load_{dc}$ is the instantaneous data center load based on actions taken by agent $A_E$ (e.g., energy consumption RL agent 134) and subsequently load shifted by agent $A_{LS}$ (e.g., load shifting RL agent 136), $Battery_{SOC}$ is the battery State of Charge (SoC) and CI is the current CI and its forecast up to a time-step t+N. Here, N is a parameter that can be chosen depending on the reliability of the forecast model. In an example implementation, a conservative estimate of N=4 hours can be utilized. The action space A can be provided as $\{i_t, \ldots, i_{t+N}\}$, where each $i_\tau$ for $\tau \in (t, t+N)$ indicates the possible actions of charge, discharge or stay idle for the battery at each of these time steps. Hence, at each time step τ the energy storage RL agent 138 will plan for the next N steps. However, when sending the action to the actual battery system included in the data center 176, the action at time step τ=t can be used.

The reward may be the net carbon footprint for the battery over the N steps based on the above action sequence of length N. Thus, at each time step, the net energy drawn from the grid ($ng_\tau$, $\tau \in (t, t+N)$) can be calculated based on the action sequence and multiplied with the corresponding carbon intensity of the grid $CI_t, \ldots, CI_{t+N}$ at those time instants. For example, the reward ($r_t$) can computed from a scalar dot product of a vector of the net energy drawn for the grid ($\overline{ng_\tau}$) and a vector of carbon intensity on the grid ($CI_\tau$) (e.g., $r_t(s_t,a_t)=-\overline{ng_\tau}\cdot\overline{CI_\tau}$). This reward function can be referred to as the energy storage reward function ($r_{BAT}$), which can be described as $r_{BAT}=-(CO_2\text{Footprint})$. The action space can be implemented as a multi-discrete space in the environment. The transition function $p(s_t, a_t, s_{t+1})$ is based on a linear battery degradation model, as is known in the art.

Additionally, according to some examples, realistic charging and discharging rate limits can be imposed to make the battery operation more realistic. This can be done by deriving charging and discharging rates from sigmoid curves for the battery storage subsystem. These curves generate linear charging/discharging rates under the nominal battery SoC. The charging rate is highest at low SoC and vice-versa. Similarly, the discharging rates may be lowest at low SoC and vice-versa. For the data center demand curve, the instantaneous data center demand can be used, which can be based on the optimal performance under the agent $A_E$ (e.g., energy consumption RL agent 134). The carbon intensity values can be estimated based on the instantaneous availability of different energy sources in the grid.

Table 1 below summarizes the above MDP formulations.

TABLE 1

| | $MDP_{LS}$ Flexible Load Shifting | $MDP_E$ Energy HVAC Optimizer | $MDP_{BAT}$ Battery Agent |
|---|---|---|---|
| State: $S_t$ | Time, DC temperature, IT Load, Unassigned Flexible Load, DC Energy, Carbon Intensity, Battery charge | Time, DC temperature, Weather, DC Energy, IT Load, HVAC Setpoint | Time, DC Energy, Battery Charge, Carbon Intensity |
| Action: $A_t$ | Assign Flexible Load, Idle | HVAC Setpoint | Charge, Supply, Idle |
| Reward: $R_{t+1}(S_t, A_t)$ | $0.8 * r_{LS} + 0.1 * r_E + 0.1 * r_{BAT}$ | $0.1 * r_{LS} + 0.8 * r_E + 0.1 * r_{BAT}$ | $0.1 * r_{LS} + 0.1 * r_E + 0.8 * r_{BAT}$ |

As can be seen from the MDP descriptions in Table 1, there is a chain of dependencies from the load shifting RL agent 136, through the energy consumption RL agent 134, and then through the energy storage RL agent 138. The energy consumption RL agent 134 decides whether or not to shift the load based on the current workload, the grid CI, the current power consumption by the data center, and the current thermal state of data center. The resulting workload is used by the energy consumption RL agent 134 along with other variables, such as, weather forecasts and current battery SoC, to optimize energy operation given the temperature setpoint. The cooling subsystem model 120 is then used to estimate the energy consumption in the next interval. This information, along with the grid CI, is considered by the energy storage RL agent 138 to charge, discharge the battery (or remain idle) using the power grid, supply auxiliary power to reduce grid dependency.

The multi-step and cyclic dependency in the above problem formulation creates opportunities for incremental energy and carbon footprint savings while having some challenges with respect to training convergence for the RL agents. A collaborative reward framework, similar to multi-agent reinforcement learning (MARL), can be employed help the RL agents assign the common state variables obtained from other MDPs to the agent's rewards. The collaborative reward framework, an example of which is provided in Table 1, aggregates the reward functions of the individual MDPs into a collaborative reward function that is tailored to each MDP. For example, for a given MDP formulation, the reward function is a summation of the individual reward functions of each MDP formulation, where each individual reward function is weighted according to a preset weight. A weight applied to an individual reward function corresponding to a given MDP formulation is larger than the weights applied to the other reward functions. For example, as shown in Table 1, for $MDP_{LS}$, the weight applied to $r_{LS}$ is 0.8 and the weights applied to $r_{BAT}$ and $r_E$ are 0.1. Similar weightings are shown for $MDP_E$ and $MDP_{BAT}$. However, these are illustrative examples. Any weighting as desired may be applied such that the collaborative reward is $w_1*r_{LS}+w_2*r_E+w_3*r_{BAT}$, where $w_1+w_2+w_3=1$.

Furthermore, the lower weighted reward functions need not have the same weight. For example, in the case of $MDP_{LS}$, the collaborative reward may be $w_1*r_{LS}+w_2*r_E+w_3*r_{BAT}$, where $w_1$ is greater than $w_2$ and $w_3$. In this case, $w_2$ and $w_3$ may be the same value or different and $w_2$ may be greater than or less than $w_3$. As an example, the collaborate reward for $MDP_{LS}$ may be $0.7*r_{LS}+0.1*r_E+0.2*r_{BAT}$. Weights for the other MDPs may be implemented according to similar principles.

Figure 3:
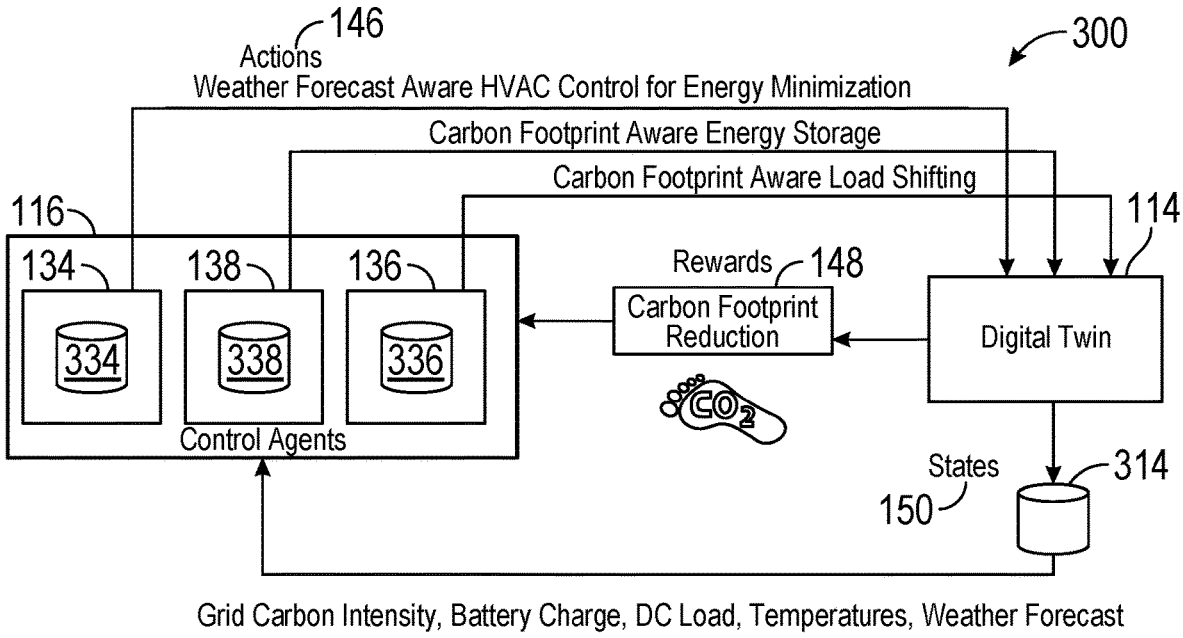
FIG. 3 is a schematic block diagram of example process of reinforcement learning in accordance with implementations of the present disclosure.

FIG. 3 is a schematic block diagram of example process 300 of RL in accordance with implementations of the present disclosure. Process 300 illustrates a generalized Multi-agent Reinforcement Learning algorithm (MARL) process executed by the framework 110 using the above described MDP formulations: $MDP_{LS}$, $MDP_E$, and $MDP_{BAT}$. The goal of process 300 is for the RL agents 134-136 to learn a policy that optimally reduces total carbon footprint of the data center (e.g., data center 176) in real-time by solving the multiple MDP simultaneously in the digital twin 114.

Process 300 provides an example of reinforcement learning performed by the control agents 116 for learning optimal policies that maximize individually tailored collaborative reward functions based on discrete rewards received from a digital twin 114. For example, control agents 116 include RL agents 134-138 that can be provided as ML algorithms that interact with corresponding subsystem models of the digital twin 114 in discrete time steps via RL agent wrapper 152 (not shown in FIG. 3). At each time t, each RL agent receives current state information 150 and reward information 148 from the corresponding subsystem models of the digital twin 114. State information 150 can also include external information obtained from the real-world environment, such as, weather forecasts, CI forecasts, and workload forecasts.

Each RL agent 134-138 chooses an action 146 from a set of available actions, which is sent to the corresponding subsystem models of digital twin 114. The digital twin 114 moves to a new state (e.g., each subsystem transitions to a new state based on the received actions) and determines an updated reward information associated with the transition. For example, the RL agent 134-138 compute actions 146 that are sent to cooling subsystem model 120, energy storage subsystem model 130, and load shifting model subsystem model 132 (not shown in FIG. 3), respectively, which causes each subsystem model to transition to a new state and compute an discrete reward for that new state (e.g., $r_{LS}$, $r_E$, and $r_{BAT}$). The updated states and reward information are then provided back to the RL agents 134-138, each of which computes an individually tailored collaborative reward as described above and updates its policy. The RL agents 134-138 then compute a next action for the next time step t+N. The goal of the RL agents 134-138 is to learn policies which maximize its corresponding collaborative reward function.

In more detail, a systematic implementation of the multiple agents can be executed that accounts for the interdependency depicted in FIG. 2 between each agent actions and next states. The load shifting RL agent 136, energy consumption RL agent 134, and energy storage RL agent 138 can be simultaneously initialized for optimal load shifting ($MDP_{LS}$), optimizing energy ($MDP_E$), and the optimal battery operation ($MDP_{BAT}$), respectively. At this time, digital twin 114 can be initialized, including cooling subsystem model 120, energy storage subsystem model 130, and load shifting model subsystem model 132. State variables, such as, data center temperature, total IT workload, unassigned flexible load, data center energy usage, and battery SoC information can be obtained from the digital twin 114 and/or data center 176 and stored to a database 314 as state information 150. The state information can be derived by the cooling subsystem model 120, energy storage subsystem model 130, and load shifting model subsystem model 132 and provided to database 314 for storage. Grid data, such as but not limited to, carbon intensity, weather conditions and data center workload data can also be stored to database 314 as state information 150 for each time instant. This state information 150 can thus be shared between the RL agents 134-138. In real-time, each RL agent 134-138 interacts with its respective MDP to collect rollout information ($s_t$, $A_t$, $s_t'$, $R_{t+1}$, $\gamma$, done) in respective memory buffers 334, 336, and 338. Note that $s_t'$ may be interchangeable with $s_{t+1}$, as discussed above. "Done" represents a Boolean flag used in RL to indicate termination of an episode, which may be the duration of a rollout and may be determined by the environment/MDP. Examples of the rollout information are provided in Table 1 above. As used herein, "interacts" can refer to the RL agent executing actions (not solving) on the MDP to obtain rollout information as an output. The term "solve" may have a separate meaning in RL parlance, where in the methods of RL used herein, an RL agent may not solve the MDP directly but rather indirectly by interacting with the MDP and forming an internal representation of the MDP.

In operation, load shifting RL agent 136 queries the state information 150 for time and grid carbon intensity. The load shifting RL agent 136 obtains unassigned flexible load from $MDP_{LS}$; the energy consumption RL agent 134 obtains data center temperature, current IT load, and data center energy usage from $MDP_E$; and the energy storage RL agent 138 obtains battery SoC information from $MDP_{BAT}$. Load shifting RL agent 136 uses this information to decide its action on whether to reassign flexible load from this time step to another time step or to stay idle. The resulting IT load information is passed to the energy consumption RL agent 134. Energy consumption RL agent 134 uses time, as well as, data center temperature, data center energy consumption, and temperature set point obtained from a previous time step of $MDP_E$ to decide a set point for the current time step. The cooling subsystem model 120 of the digital twin 114 calculates a resulting change in energy consumption and data center temperature, which cooling subsystem model 120 communicates back to the $MDP_E$. The energy storage RL agent 138 obtains the time, data center energy usage from $MDP_E$, current battery charge, and the carbon intensity information to decide whether to charge the battery from the grid, discharge the battery to supplement energy demand of the digital twin 114, or remain idle.

In an example, the RL agents 134-138 each determine their respective actions and issue the actions to the environment at the same time step. The actions, however, can be executed on the environment in according to an order. In an example implementation, the order may be load shifting subsystem, cooling subsystem, and battery storage subsystem. While in another example, the order may be different depending on the desired application.

In another example implementation at each rollout step (e.g., each time step), the RL agents may complete one step of interaction with their respective MDPs effectively providing an asynchronous concurrent rollout. From an implementation perspective according to this example, the individual RL agents need not receive the rollout information tuple immediately after taking an action. They may wait until it is their turn to determine and issue an action again. This waiting may permit incorporation of effects of previous actions taken by the other RL agents into all the MDPs, which can be used to inform the individually tailored collaborative reward of each RL agent. That is, at each time step, each RL agent can interact with its respective MDP to compute an individually tailored collaborative reward that can be used to inform the actions for a next time step. Thus, the individually tailored collaborative rewards consider the effects of actions from all RL agents. This hierarchical formulation is also shown in Table 1 and can enable the RL agents to consider the effects of their individual actions across interdependent MDPs.

At regular intervals, the data held in the memory buffers 334, 336, and 338 can be used to update policies of each respective agent. In an example implementation, policies can be updated using a PPO algorithm to learn a decentralized policy and a decentralized critic (value function). In this case, each RL agent interacts through its individualized tailored collaborative reward function and shared state information, but is otherwise unaware of the actions taken by other agents. However, any other off-policy or policy gradient algorithm may be used. For example, some implementations can use a Multi-agent Deep Deterministic Policy Gradient (MADDPG) algorithm that extends the Deep Deterministic Policy Gradient (DDPG) algorithm into a multi-agent policy gradient algorithm where decentralized agents learn a centralized critic based on the observations and actions of all agent. Here a critic refers to a part of a class of RL algorithms consisting of an actor and a critic. The actor (or the policy) decides the actions, while the critic provides a measure of how good or bad the actions are (e.g., the reward) to inform the policies. In this example case, the learned policies use local information of each corresponding actor during test time, and not the information of other actors. However, each agent may use observations and actions of each of the three agents.

An example algorithm for training the RL agents 134-138 is provided below in pseudo code:

Algorithm 1 Data Center Carbon Footprint Reduction DC-CFR Multi-Agent Algorithm

Figure 4:
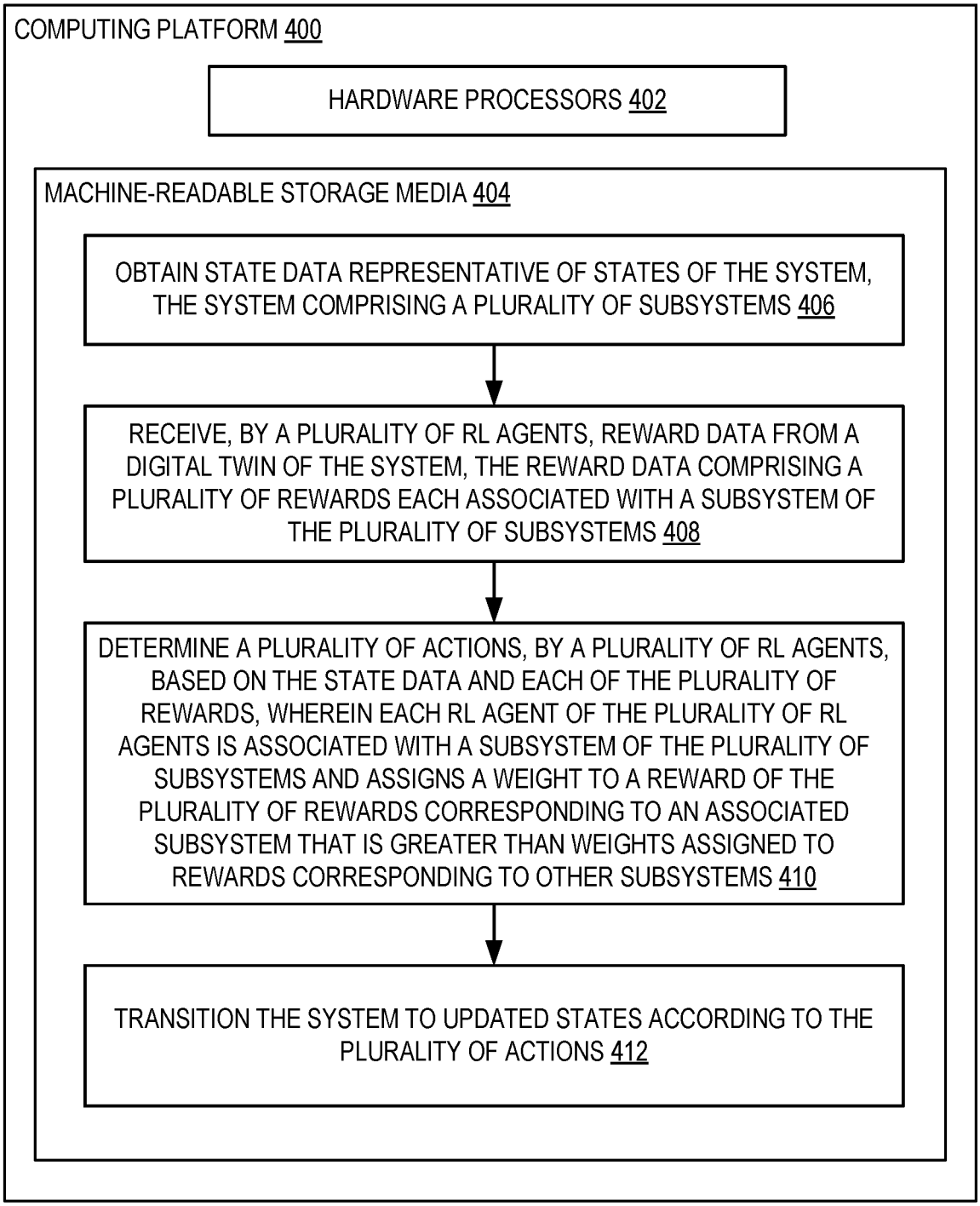
FIG. 4 is an example computing component that may be used to implement various features of carbon footprint reduction in accordance with the implementations disclosed herein.

Require: RL Agents $A_{LS}$, $A_E$ and $A_{BAT}$ ▷ RI Algorithm initialization
Require: $\overline{CI}$ ▷ Carbon Intensity data from the grid
Require: $\overline{EW}$ ▷ Weather data obtained from Energy Plus
Require: Workload Model $MDP_{LS}$ ▷ Model data center workload assignment
Require: Data Center Model $MDP_E$ ▷ Model Data Center Thermodynamics in Energy Plus
Require: Battery Model $MDP_{BAT}$ ▷ Model Battery operation
For $i \in 1,\ldots,L_b$ do ▷ $L_b$ is the learning iterations budget
  Concurrent Rollout Phase
  while episode not done do
    State information is shared among the different MDPs
    Agent $A_{LS}$ sends action to $MDP_{LS}$ and collects ($s_t$, $a_t$, $\acute{s}_t$, $r_t$, $\gamma$, done) in its replay buffer $D_{LS}$
    Agent $A_E$ sends action to $MDP_E$ and collects ($s_t$, $a_t$, $\acute{s}_t$, $r_t$, $\gamma$, done) in its replay buffer $D_E$
    Agent $A_{BAT}$ sends action to $MDP_{BAT}$ and collects ($s_t$, $a_t$, $\acute{s}_t$, $r_t$, $\gamma$, done) in its replay buffer $D_{BAT}$
  end while
  Concurrent Policy Updates
  Update Agent Networks by training $A_E$ on $D_E$, $A_{LS}$ on $D_{LS}$ and $A_{BAT}$ on $D_{BAT}$
end for FIG. 4 illustrates an example computing component that may be used to implement carbon footprint reduction of a system in accordance with various embodiments. Referring now to FIG. 4, computing component 400 may be, for example, a server computer, a controller, or any other similar computing component capable of processing data. In the example implementation of FIG. 4, the computing component 400 includes a hardware processor 402, and machine-readable storage medium for 404.

Hardware processor 402 may be one or more central processing units (CPUs), semiconductor-based microprocessors, and/or other hardware devices suitable for retrieval and execution of instructions stored in machine-readable storage medium 404. Hardware processor 402 may fetch, decode, and execute instructions, such as instructions 406-412, to control processes or operations for carbon footprint reduction. As an alternative or in addition to retrieving and executing instructions, hardware processor 402 may include one or more electronic circuits that include electronic components for performing the functionality of one or more instructions, such as a field programmable gate array (FPGA), application specific integrated circuit (ASIC), or other electronic circuits.

A machine-readable storage medium, such as machine-readable storage medium 404, may be any electronic, magnetic, optical, or other physical storage device that contains or stores executable instructions. Thus, machine-readable storage medium 404 may be, for example, Random Access Memory (RAM), non-volatile RAM (NVRAM), an Electrically Erasable Programmable Read-Only Memory (EEPROM), a storage device, an optical disc, and the like. In some embodiments, machine-readable storage medium 404 may be a non-transitory storage medium, where the term "non-transitory" does not encompass transitory propagating signals. As described in detail below, machine-readable storage medium 404 may be encoded with executable instructions, for example, instructions 406-412.

Hardware processor 402 may execute instruction 406 to obtain state data representative of states of the system. The system comprises a plurality of subsystems.

For example, the system may be a data center comprising a cooling subsystem, a load shifting subsystem, and an energy storage subsystem. State data can be obtained as operating conditions from the physical data center, for example, from sensors that monitor the operating conditions of the data center. The state data, according to some examples, can comprise internal states of the system and external states of an environment for the system. The internal states may comprise one or more of allocated workload, unallocated workload, temperature of the system, energy consumption by the system, and energy stored by the system. The external states may comprise one or more of grid carbon intensity, weather, and time of day.

Hardware processor 402 may execute instruction 408 to receive, by a plurality of RL agents, reward data from rom a digital twin of the system that simulates operations of the system. The reward data comprises a plurality of rewards each associated with a subsystem of the plurality of subsystems.

For example, the digital twin may be a simulation of the data center, as described above in connection with FIGS. 1A and 1B. The digital twin may receive state data that configures the digital twin to simulate operating conditions of the current state of the data center, The digital twin may also receive action data that simulates a transition between states of the digital twin. Based on the transition, the digital twin may generate reward data that is representative of an effectiveness of the actions. The digital twin may provide the reward data to the plurality of RL agents for training the RL agents.

Each subsystem of the digital twin may generate a respective reward, which can be included in the reward data that is provided to each of the plurality of RL agents. For example, a first reward of the plurality of rewards corresponding to the cooling subsystem may be based on a simulation of energy consumed by the cooling subsystem model (e.g., digital twin of the cooling subsystem) and a simulation of energy costs. A second reward of the plurality of rewards corresponding to a load shifting subsystem model may be based on a carbon footprint resulting from a simulation of a load shifting subsystem model (e.g., digital twin of the load shifting subsystem subsystem) and unallocated flexible workload. A third reward of the plurality of rewards corresponding to the energy storage subsystem may be based on a simulation of a carbon footprint of the energy storage subsystem by the energy storage subsystem model (e.g., digital twin of the energy storage subsystem).

Hardware processor 402 may execute instruction 410 to determine a plurality of actions, by the plurality of RL agents, based on the state data and each of the plurality of rewards. Each RL agent of the plurality of RL agents may be associated with a subsystem of the plurality of subsystems and assigns a weight to a reward of the plurality of rewards corresponding to the associated subsystem that is greater than weights assigned to rewards corresponding to the other subsystems. Thus, the individual rewards from each subsystem model can be aggregated into a collaborative reward that is individually tailored for each respective RL agent. The individually tailored collaborative rewards may be representative of an effectiveness of actions taken by each RL agent for not only the corresponding system, but also the system as a whole through consideration of the rewards associated with other subsystems.

As described above in connection with FIGS. 1A and 1B, the plurality of RL agents may comprise energy consumption RL agent, load shifting RL agent, and energy storage RL agent corresponding to a cooling subsystem, a load shifting subsystem, and an energy storage subsystem, respectively. The various subsystems are interdependent on each other, and as such the RL agents are configured to determine actions dependent on both the previous rewards and actions of the other subsystem.

In some examples, the action determined by the reinforcement learning agent associated with the cooling subsystem may be a cooling setpoint for the cooling subsystem. An action determined by the reinforcement learning agent associated with the load shifting subsystem may be an allocation of workload. An action determined by the reinforcement learning agent associated with the energy storage subsystem may be a charge or discharge amount from for the energy storage subsystem.

In an example, the reinforcement learning agents determine their respective actions and issue the actions at the same time step. The actions can be executed on the environment in an order of load shifting subsystem, cooling subsystem, and battery storage subsystem.

Hardware processor 402 may execute instruction 412 to transition the system to updated states according to the plurality of actions. For example, control instructions can be generated by the RL agents that represent optimal policies learned from RL based on the individually tailored collaborative rewards. The control instructions can be transmitted to the system (e.g., data center) for configuring operating conditions of the system to transition the system to updated state that optimize the carbon footprint of the system in view of the current internal and external states. Thus, flexible workloads can be allocated in view of grid CI and battery storage systems SoC, as well as cooling strategies in view of upcoming weather. Furthermore, cooling subsystems can be controlled to regulate temperature based on workload allocated (both flexible and inflexible), as well as taking into consideration current grid CI and battery SoC. Further still, the battery storage system can be optimized to charge batteries during low grid CI and discharge batteries during high grid CI dependent on power consumption needs of the data center.

Figure 5:
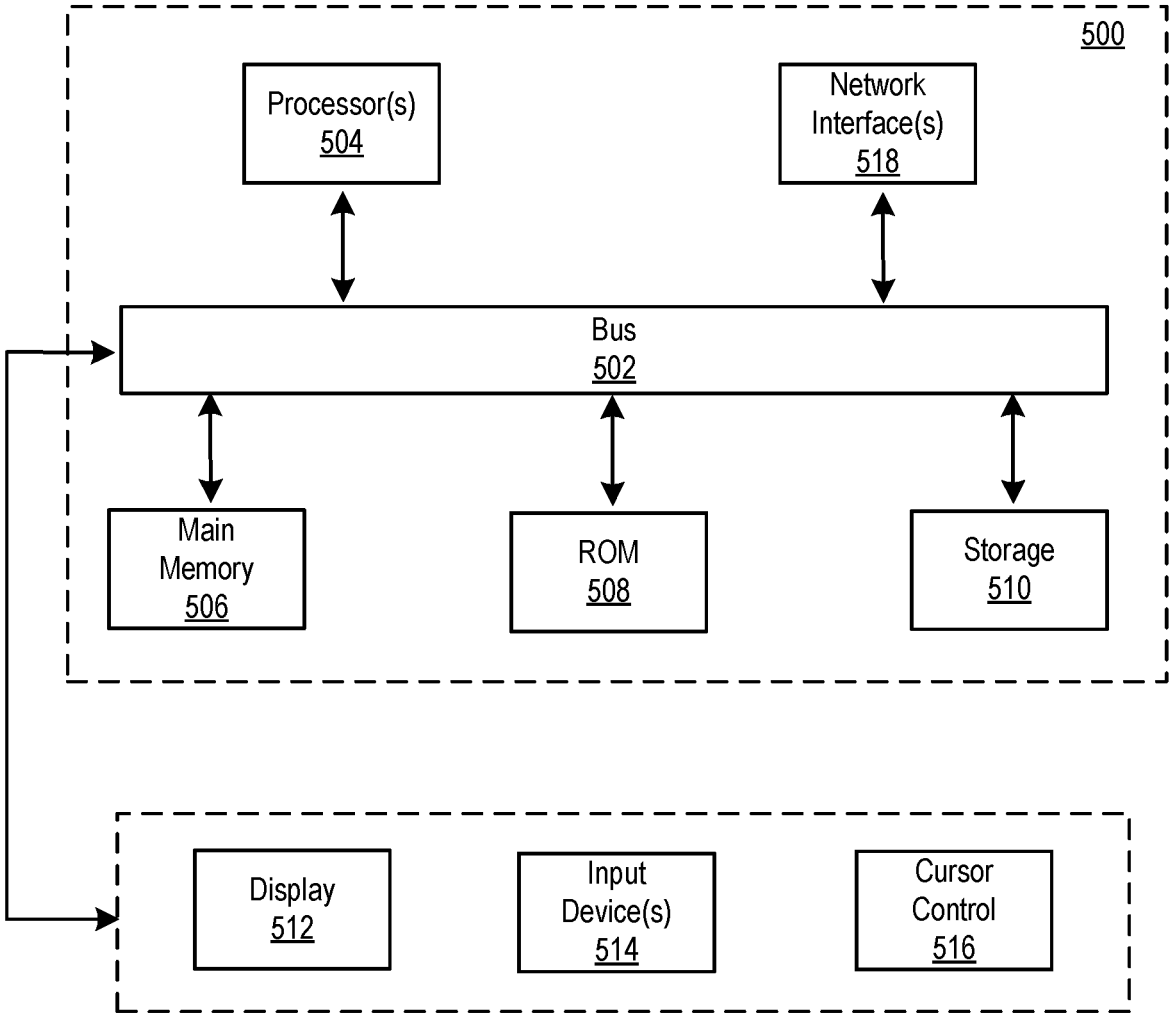
FIG. 5 is an example computer system that may be used to implement various features of carbon footprint reduction of the present disclosure.

FIG. 5 depicts a block diagram of an example computer system 500 in which various of the embodiments described herein may be implemented. The computer system 500 includes a bus 502 or other communication mechanism for communicating information, one or more hardware processors 504 coupled with bus 502 for processing information. Hardware processor(s) 504 may be, for example, one or more general purpose microprocessors.

The computer system 500 also includes a main memory 506, such as a random access memory (RAM), cache and/or other dynamic storage devices, coupled to bus 502 for storing information and instructions to be executed by processor 504. Main memory 506 also may be used for storing temporary variables or other intermediate information during execution of instructions to be executed by processor 504. Such instructions, when stored in storage media accessible to processor 504, render computer system 500 into a special-purpose machine that is customized to perform the operations specified in the instructions. Main memory 506 may store information containing machine readable instructions for providing functionality of framework 110, such as digital twin 114 and subsystem models therein, control agents 116, and other components of framework 110.

The computer system 500 further includes a read only memory (ROM) 508 or other static storage device coupled to bus 502 for storing static information and instructions for processor 504. A storage device 510, such as a magnetic disk, optical disk, or USB thumb drive (Flash drive), etc., is provided and coupled to bus 502 for storing information and instructions.

The computer system 500 may be coupled via bus 502 to a display 512, such as a liquid crystal display (LCD) (or touch screen), for displaying information to a computer user. An input device 514, including alphanumeric and other keys, is coupled to bus 502 for communicating information and command selections to processor 504. Another type of user input device is cursor control 516, such as a mouse, a trackball, or cursor direction keys for communicating direction information and command selections to processor 504 and for controlling cursor movement on display 512. In some embodiments, the same direction information and command selections as cursor control may be implemented via receiving touches on a touch screen without a cursor.

In some implementations, input device 514 may include ports or other input interfaces for receiving input data from a real-world system, such as physical system 160 and sensors/IoT devices therein. Thus, input device 514 may receive input data including internal states and external factors as described above in connection with FIGS. 1A and 1B.

The computing system 500 may include a user interface module to implement a GUI that may be stored in a mass storage device as executable software codes that are executed by the computing device(s). This, and other modules may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables.

In general, the word "component," "engine," "system," "database," data store," and the like, as used herein, can refer to logic embodied in hardware or firmware, or to a collection of software instructions, possibly having entry and exit points, written in a programming language, such as, for example, Java, C or C++. A software component may be compiled and linked into an executable program, installed in a dynamic link library, or may be written in an interpreted programming language such as, for example, BASIC, Perl, or Python. It will be appreciated that software components may be callable from other components or from themselves, and/or may be invoked in response to detected events or interrupts. Software components configured for execution on computing devices may be provided on a computer readable medium, such as a compact disc, digital video disc, flash drive, magnetic disc, or any other tangible medium, or as a digital download (and may be originally stored in a compressed or installable format that requires installation, decompression or decryption prior to execution). Such software code may be stored, partially or fully, on a memory device of the executing computing device, for execution by the computing device. Software instructions may be embedded in firmware, such as an EPROM. It will be further appreciated that hardware components may be comprised of connected logic units, such as gates and flip-flops, and/or may be comprised of programmable units, such as programmable gate arrays or processors.

The computer system 500 may implement the techniques described herein using customized hard-wired logic, one or more ASICs or FPGAs, firmware and/or program logic which in combination with the computer system causes or programs computer system 500 to be a special-purpose machine. According to one embodiment, the techniques herein are performed by computer system 500 in response to processor(s) 504 executing one or more sequences of one or more instructions contained in main memory 506. Such instructions may be read into main memory 506 from another storage medium, such as storage device 510. Execution of the sequences of instructions contained in main memory 506 causes processor(s) 504 to perform the process steps described herein. In alternative embodiments, hard-wired circuitry may be used in place of or in combination with software instructions.

The term "non-transitory media," and similar terms, as used herein refers to any media that store data and/or instructions that cause a machine to operate in a specific fashion. Such non-transitory media may comprise non-volatile media and/or volatile media. Non-volatile media includes, for example, optical or magnetic disks, such as storage device 510. Volatile media includes dynamic memory, such as main memory 506. Common forms of non-transitory media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge, and networked versions of the same.

Non-transitory media is distinct from but may be used in conjunction with transmission media. Transmission media participates in transferring information between non-transitory media. For example, transmission media includes coaxial cables, copper wire and fiber optics, including the wires that comprise bus 502. Transmission media can also take the form of acoustic or light waves, such as those generated during radio-wave and infra-red data communications.

The computer system 500 also includes a network interface 518 coupled to bus 502. Network interface 518 provides a two-way data communication coupling to one or more network links that are connected to one or more local networks. For example, communication interface 518 may be an integrated services digital network (ISDN) card, cable modem, satellite modem, or a modem to provide a data communication connection to a corresponding type of telephone line. As another example, network interface 518 may be a local area network (LAN) card to provide a data communication connection to a compatible LAN (or WAN component to communicated with a WAN). Wireless links may also be implemented. In any such implementation, network interface 518 sends and receives electrical, electromagnetic or optical signals that carry digital data streams representing various types of information.

Communication interface 518 may input interfaces for receiving input data from a real-world system, such as physical system 160 and sensors/IoT devices therein, via a network (e.g., network 190). Thus, network interface 518 may receive input data including internal states and external factors as described above in connection with FIGS. 1A and 1B.

A network link typically provides data communication through one or more networks to other data devices. For example, a network link may provide a connection through local network to a host computer or to data equipment operated by an Internet Service Provider (ISP). The ISP in turn provides data communication services through the world wide packet data communication network now commonly referred to as the "Internet." Local network and Internet both use electrical, electromagnetic or optical signals that carry digital data streams. The signals through the various networks and the signals on network link and through communication interface 518, which carry the digital data to and from computer system 500, are example forms of transmission media.

The computer system 500 can send messages and receive data, including program code, through the network(s), network link and communication interface 518. In the Internet example, a server might transmit a requested code for an application program through the Internet, the ISP, the local network and the communication interface 518.

The received code may be executed by processor 504 as it is received, and/or stored in storage device 510, or other non-volatile storage for later execution.

Each of the processes, methods, and algorithms described in the preceding sections may be embodied in, and fully or partially automated by, code components executed by one or more computer systems or computer processors comprising computer hardware. The one or more computer systems or computer processors may also operate to support performance of the relevant operations in a "cloud computing" environment or as a "software as a service" (SaaS). The processes and algorithms may be implemented partially or wholly in application-specific circuitry. The various features and processes described above may be used independently of one another, or may be combined in various ways. Different combinations and sub-combinations are intended to fall within the scope of this disclosure, and certain method or process blocks may be omitted in some implementations. The methods and processes described herein are also not limited to any particular sequence, and the blocks or states relating thereto can be performed in other sequences that are appropriate, or may be performed in parallel, or in some other manner. Blocks or states may be added to or removed from the disclosed example embodiments. The performance of certain of the operations or processes may be distributed among computer systems or computers processors, not only residing within a single machine, but deployed across a number of machines.

As used herein, a circuit might be implemented utilizing any form of hardware, software, or a combination thereof. For example, one or more processors, controllers, ASICs, PLAS, PALs, CPLDs, FPGAs, logical components, software routines or other mechanisms might be implemented to make up a circuit. In implementation, the various circuits described herein might be implemented as discrete circuits or the functions and features described can be shared in part or in total among one or more circuits. Even though various features or elements of functionality may be individually described or claimed as separate circuits, these features and functionality can be shared among one or more common circuits, and such description shall not require or imply that separate circuits are required to implement such features or functionality. Where a circuit is implemented in whole or in part using software, such software can be implemented to operate with a computing or processing system capable of carrying out the functionality described with respect thereto, such as computer system 500.

As used herein, the term "or" may be construed in either an inclusive or exclusive sense. Moreover, the description of resources, operations, or structures in the singular shall not be read to exclude the plural. Conditional language, such as, among others, "can," "could," "might," or "may," unless specifically stated otherwise, or otherwise understood within the context as used, is generally intended to convey that certain embodiments include, while other embodiments do not include, certain features, elements and/or steps.

Terms and phrases used in this document, and variations thereof, unless otherwise expressly stated, should be construed as open ended as opposed to limiting. Adjectives such as "conventional," "traditional," "normal," "standard," "known," and terms of similar meaning should not be construed as limiting the item described to a given time period or to an item available as of a given time, but instead should be read to encompass conventional, traditional, normal, or standard technologies that may be available or known now or at any time in the future. The presence of broadening words and phrases such as "one or more," "at least," "but not limited to" or other like phrases, in some instances, shall not be read to mean that the narrower case is intended or required in instances where such broadening phrases may be absent.

What is claimed is:

1. A method, comprising:

obtaining state data representative of states of the system, the system comprising a plurality of subsystems, wherein the plurality of subsystems comprises a cooling subsystem, a load shifting subsystem, and an energy storage subsystem;

receiving, by a plurality of reinforcement learning agents, reward data from a digital twin of the system that simulates operations of the system, the reward data comprising a plurality of rewards each associated with a subsystem of the plurality of subsystems, and wherein:

a first reward of the plurality of rewards corresponding to the cooling subsystem is based on a measure of energy consumed by the system and energy costs, a second reward of the plurality of rewards corresponding to the load shifting subsystem is based on a carbon footprint of the load shifting subsystem and unallocated workload, and a third reward of the plurality of rewards corresponding to the energy storage subsystem is based on a carbon footprint of the energy storage subsystem;

determining a plurality of actions, by the plurality of reinforcement learning agents, based on the state data and each of the plurality of rewards, wherein each reinforcement learning agent of the plurality of reinforcement learning agents is associated with a subsystem of the plurality of subsystems and assigns a weight to a reward of the plurality of rewards corresponding to an associated subsystem of the plurality of subsystems that is greater than weights assigned to rewards corresponding to other subsystems of the plurality of subsystems; and transition the system to updated states according to the plurality of actions.

2. The method of claim 1, wherein the system is a data center.

3. The method of claim 1, wherein an action determined by a reinforcement learning agent associated with the cooling subsystem is dependent on an action determined by a reinforcement learning agent associated with the load shifting subsystem and an action determined by a reinforcement learning agent associated with the energy storage subsystem.

4. The method of claim 1, wherein an action determined by a reinforcement learning agent associated with the cooling subsystem is a cooling setpoint for the system, where an action determined by a reinforcement learning agent associated with the load shifting subsystem is an allocation of workload, and wherein an action determined by a reinforcement learning agent associated with the energy storage subsystem is a charge or discharge amount.

5. The method of claim 1, wherein an action determined by a reinforcement learning agent associated with the load shifting subsystem is dependent on an action determined by a reinforcement learning agent associated with the cooling subsystem and an action determined by a reinforcement learning agent associated with the energy storage subsystem.

6. The method of claim 1, wherein an action determined by a reinforcement learning agent associated with the energy storage subsystem is dependent on an action determined by a reinforcement learning agent associated with the cooling subsystem and an action determined by a reinforcement learning agent associated with the load shifting subsystem.

7. The method of claim 1, wherein the state data comprises internal states of the system and environmental states of an environment for the system, wherein the internal states comprise one or more of allocated workload, unallocated workload, temperature of the system, energy consumption by the system, or energy stored by the system, and wherein the environmental states comprise one or more of grid carbon intensity, weather, or time.

8. A system for carbon footprint reduction of a system, comprising:

a memory storing instructions; and one or more processors coupled to the memory and configured to execute the instructions to:

obtain state data representative of states of the system, wherein the state data comprises internal states of the system and environmental states of an environment for the system, wherein the internal states comprise one or more of allocated workload, unal located workload, temperature of the system, energy consumption by the system, and energy stored by the system, and wherein the environmental states comprise one or more of grid carbon intensity, weather, and time, and wherein the system comprising a plurality of subsystems;

receive reward data from a digital twin of the system that simulates operations of the system, the reward data comprising a plurality of rewards each associated with a subsystem of the plurality of subsystems;

determine a plurality of actions, by a plurality of reinforcement learning agents, based on the state data and each of the plurality of rewards, wherein each reinforcement learning agent of the plurality of reinforcement learning agents is associated with a subsystem of the plurality of subsystems and assigns a weight to a reward of the plurality of rewards corresponding to the an associated subsystem of the plurality of subsystems that is greater than weights assigned to rewards corresponding to the other subsystems of the plurality of subsystems; and transition the system to updated states according to the plurality of actions.

9. The system of claim 8, wherein the system is a data center, and wherein the plurality of subsystems comprises a cooling subsystem, a load shifting subsystem, and an energy storage subsystem.

10. The system of claim 9, wherein an action determined by a reinforcement learning agent associated with the cooling subsystem is dependent on an action determined by a reinforcement learning agent associated with the load shifting subsystem and an action determined by a reinforcement learning agent associated with the energy storage subsystem.

11. The system of claim 9, wherein an action determined by a reinforcement learning agent associated with the cooling subsystem is a cooling setpoint for the system, where an action determined by a reinforcement learning agent associated with the load shifting subsystem is an allocation of workload, and wherein an action determined by a reinforcement learning agent associated with the energy storage subsystem is a charge or discharge amount.

12. The system of claim 9, wherein an action determined by a reinforcement learning agent associated with the load shifting subsystem is dependent on an action determined by a reinforcement learning agent associated with the cooling subsystem and an action determined by a reinforcement learning agent associated with the energy storage subsystem.

13. The system of claim 9, wherein an action determined by a reinforcement learning agent associated with the energy storage subsystem is dependent on an action determined by a reinforcement learning agent associated with the cooling subsystem and an action determined by a reinforcement learning agent associated with the load shifting subsystem.

14. A system, comprising:

a hardware processor;

a non-transitory machine-readable storage medium storing instructions that, when executed by the processor, cause the processor to:

initiate a digital twin of a data center, the digital twin comprising a plurality of subsystem models corresponding to a plurality of subsystems of the data center and configured to simulate states of received environmental states of an environment for the data center, comprising one or more of grid carbon intensity, weather, or and time, for each subsystem model and determine rewards for each subsystem model, wherein the simulated states comprise one or more of allocated workload, unallocated workload, temperature of the data center, energy consumption by the data center, and energy stored by the data center; and initiate a plurality of reinforcement learning agents interfaced with the digital twin and configured to:

receive the simulated states and the rewards from a digital twin, aggregate the rewards, determine actions for each subsystem model based on the aggregated rewards, and generate control signals for each subsystem according to the determined actions, wherein the data center is configured based on the control signals.

15. The system of claim 14, wherein the plurality of subsystem models comprises a cooling subsystem model, a load shifting subsystem model, and an energy storage subsystem model.

16. The system of claim 14, wherein each reinforcement learning agent of the plurality of reinforcement learning agents is associated with a subsystem model of the plurality of subsystem models, and wherein aggregating the rewards comprises:

by each reinforcement learning agent of the plurality of reinforcement learning agents, assigning a weight to a reward of the rewards determined by an associated subsystem model that is greater than weights assigned to rewards determined by the other subsystem models.

* * * * *